US005704272A

United States Patent [19]

Durako, Jr. et al.

[11] Patent Number: 5,704,272

[45] Date of Patent: Jan. 6, 1998

[54] AXIAL PISTON ENERGY CONVERTING DEVICE

[75] Inventors: William A. Durako, Jr.; Shiv C. Gupta; Jong-Yeong Yung, all of Rockford; Gerard C. Visel, Winnebago; Scott M. Thomson, Rockford, all of Ill.

[73] Assignee: Sundstrand Corporation, Rockford, Ill.

[21] Appl. No.: 703,229

[22] Filed: Aug. 26, 1996

[51] Int. Cl.[6] ..... F01B 13/04

[52] U.S. Cl. ..... 92/57; 92/71; 417/269; 74/60; 91/499

[58] Field of Search ..... 92/12.2, 57, 71; 417/269; 91/499; 74/60

[56] References Cited

U.S. PATENT DOCUMENTS

| | | | |
|---|---|---|---|
| 3,711,171 | 1/1973 | Orkin et al. . | |
| 3,996,841 | 12/1976 | Gostomski, Jr. . | |
| 4,426,914 | 1/1984 | Kline . | |
| 4,732,047 | 3/1988 | Kato et al. . | |
| 5,013,219 | 5/1991 | Hicks et al. | 417/269 |
| 5,056,417 | 10/1991 | Kato et al. | 92/71 |
| 5,392,693 | 2/1995 | Engel et al. | 92/248 |

FOREIGN PATENT DOCUMENTS

| | | | |
|---|---|---|---|
| 58-172478 | 10/1983 | Japan | 92/71 |

*Primary Examiner*—Thomas E. Denion
*Attorney, Agent, or Firm*—Lawrence E. Crowe

[57] ABSTRACT

An improved axial-piston energy converting device is provided by utilizing a thin ceramic wear plate insert, having a typical thickness of only about 0.005 to 0.040 inches in thickness, as a cam surface secured by atmospheric pressure to an underlying support surface of a steel cam plate support structure. Attachment of the wear plate to the cam plate supporting surface is accomplished by polishing both a supporting surface of the cam plate, and a mating surface of the wear plate to a very smooth finish, and wiping a thin film of a fluid such as oil onto one of the polished surfaces prior to placing the wear plate onto the supporting surface. The highly polished, together with the light film of oil, result in a joint that is essentially air tight. Atmospheric pressure acting on the cam surface of the wear plate serves to hold the wear plate tightly in place on the support surface in the same manner that a pair of Johansson blocks are held together if their highly polished surfaces are mated.

12 Claims, 3 Drawing Sheets

AXIAL PISTON ENERGY CONVERTING DEVICE

FIELD OF THE INVENTION

Our invention relates to energy converting devices, such as pumps, motors, hydrostatic transmissions, or compressors, and more particularly to axial piston energy converting devices that utilize an inclined cam surface to produce reciprocating motion of pistons in cylinders oriented parallel to a rotational axis of a driveshaft of the device.

BACKGROUND

Many energy converting devices utilize axial piston pumps, motors, or compressors to convert energy received from a rotating shaft into fluid power, or conversely to convert fluid power into rotary shaft power. Although the specific design details of such axial piston devices differ, the actual conversion of rotary to fluid power will generally be accomplished by one or more pistons that are constrained to reciprocate in cylinder bores oriented parallel to the axis of rotation of a driving or driven shaft. The reciprocating motion of the pistons is provided by connecting the pistons to a cam plate, sometimes also known as a wobbler, having a cam surface mounted at an inclined angle to the axis in such a manner that as the shaft rotates, one end of each piston slides along the cam surface. Because the cam surface is inclined with respect to the axis, the pistons are forced to reciprocate within the cylinder bores as the pistons slide along the cam surface.

In order to achieve satisfactory performance and life in such axial piston machines, special attention must be paid to the design of the connection between the piston and the cam plate surface to ensure that friction inherent in the sliding contact between the end of the piston and the cam surface is minimized. In order to minimize friction and provide acceptable operating life of the energy converting device, it is of critical importance that the surfaces of the piston and the cam plate are made from materials that in combination provide low operating friction and superior resistance to wear. Because the cam plates are often complex in shape, and therefore costly to manufacture, it is also often desirable that they be configured in a damage tolerant manner so that the axial piston device can be repaired without discarding the cam plate, following a failure of the energy converting device for reasons such as loss of lubrication between the cam surface and the pistons.

In one prior approach to solving these problems, a swiveling fitting known as a piston slipper or shoe, made from relatively soft material such as bronze, is attached to the end of the piston in contact with the cam surface, and the entire cam plate is made from a hardened material, such as 52100 steel, also known as AMS 6444, hardened to 58 Rockwell C for example. The piston slippers are also sometimes plated with an even softer material, such as silver, that has high lubricity. So long the cam surface is adequately lubricated, this approach provides reasonably low friction and operating life.

There are several disadvantages to this approach, however. First, when the cam surface eventually becomes worn, the entire cam plate must be replaced or re-machined in order to restore the cam surface to its original condition. Furthermore, where the cam surface is damaged by a failure of the energy converting device, such as a seizure of the piston slippers to the cam surface following a loss of lubrication for example, the cam plate may be damaged beyond repair. Such replacement or re-machining can impose unacceptably high refurbishment costs, particularly where the cam plate has a complex configuration.

Second, the need to manufacture the cam plate from a material that provides both structural capability and wear resistance limits the choice of acceptable materials. This results in a compromise that often requires the cam plate structure to be thicker and heavier than it would otherwise be if wear resistance were not a factor and the cam plate could be made from a material that possessed superior structural characteristics, such as 300M steel for example.

In a variation of the prior approach, the cam plate is manufactured from a material having superior structural properties, and a wear resistant coating is applied to the cam surface. Such coatings are typically applied by flame spraying the cam surface with a material such as tungsten carbide, or coating the cam surface with a material such as titanium nitride applied by a process such as Physical Vapor Deposition (PVD.) Such coatings sometimes offer improved wear performance in comparison to hardened steels and alleviate the compromises involved with using a material for the cam plate that must have both structural and wear resistance capabilities. These coatings can be costly and difficult to apply properly, however, in such a manner that they do not flake off during operation and cause premature wear or failure of the energy converting device.

In another approach, the cam plate includes a replaceable wear plate or washer insert that provides the cam surface. When the surface becomes worn or damaged, a new wear plate is installed to restore the cam plate to its original condition. Because only the wear plate is replaced, this approach can result in considerable cost savings in comparison to approaches in which the cam plate must be replaced or re-machined. Such wear plate inserts have typically been made from plated or unplated hardened steel, and have been relatively thick, with thicknesses ranging from 0.040 to 0.100 inches. U.S. Pat. No. 3,996,841 to Gostomski utilizes this approach. Gostamski teaches the use of a somewhat deformable, 0.050 inch thick preferably, steel thrust ring loosely mounted on a rough-machined or as-cast supporting surface of an inclined cam plate to eliminate the need for tight tolerance machining of the support surface, for the purpose of reducing manufacturing cost.

It has long been known that ceramic materials such as silicon carbide and silicon nitride possess wear resistance properties that are significantly better than the wear resistant properties of hardened steel. They are also less dense and stiffer than steel, with a typical Young's modulus for a ceramic material being in the range of 45 to 55 MSI, as compared to a typical Young's modulus of 30 MSI for steel. It has, therefore, long been a goal of designers of axial-piston devices to find a way to use these ceramic materials in the construction of cam plates in a manner that enhances the performance and life capabilities of energy converting devices. This goal has not heretofore been achieved due to the unique combination of properties found in such ceramic materials, together with certain difficulties incident with fabricating hardware from these materials, resulting in less than optimum reliability.

Although it might seem intuitively logical to merely replace the steel materials used in prior cam plates or wear plates with a ceramic material, it is not that simple. The hard and brittle nature of ceramics makes it highly cost prohibitive, if not impossible to produce complex shapes, like those required in many cam plates, from pure ceramic materials. Furthermore, small pits or surface imperfections in the ceramic can serve as initiation points for cracks leading eventually to failure of the part. This generally requires fine tolerance machining or polishing of all surfaces of the part, including many surfaces which are presently left in a rough-machined or in an as-cast condition on cam plates of metallic materials such as steel, iron, or aluminum. The need to machine all surfaces thus significantly increases the cost of an all ceramic part to the point that it is not practical, in most cases, to consider fabricating an entire cam plate from ceramic materials.

It has also previously been believed that the brittle nature and high stiffness of ceramic materials precluded their use in wear plates inserted into a cam plate of steel or other metallic materials. Indeed stress analysis and testing of ceramic wear plates in steel cam plate assemblies has shown this belief to be well founded. If steel wear plate inserts having a typical thickness of 0.080 to 0.100 inched thick are simply replaced with ceramic wear plates of like thickness, the ceramic inserts will generally crack and fail. This failure is likely to occur for several reasons.

Because the ceramic insert is significantly stiffer in bending than a steel insert of the same thickness, the ceramic material will not deflect as readily under load as the more ductile steel to conform to the underlying cam plate structure. Stated another way, if the ceramic plate is deflected the same distance as the steel plate, the ceramic plate will be subjected to higher internal stress. This results in the ceramic plate alone bearing a larger portion of the load than the steel plate was required to support in combination with the underlying cam plate structure. In addition, roughness on the surface of the wear plate, such as that described as being acceptable in the Gostomski patent for flexible steel inserts, will create unsupported areas and high point-contact loads in the ceramic wear plate that can lead to initiation of cracks and failure of the ceramic wear plate.

In order to solve the problems defined above it might be argued that a person having skill in the art would be inclined to achieve an acceptable stress level in the ceramic wear plate by either redesigning the underlying cam plate structure to limit its maximum deflection under load, or reducing the thickness of the ceramic insert to achieve matching deflections under load resulting in acceptably low stresses in the ceramic insert. However, either approach would in fact have heretofore been counterintuitive to a person having skill in the art.

Redesigning the underlying structure to limit its deflection would be quickly shown to involve adding considerable thickness, bulk, weight, and cost to the cam plate, making such a redesign not feasible in practice. Such an approach would also likely preclude the possibility of retrofitting a ceramic wear plate into an existing axial piston device originally designed for use with a steel wear plate, by merely substituting the ceramic plate for the steel plate.

Reducing the thickness of the ceramic wear plate to a point that internal stresses under load were reduced to acceptable loads would also have been highly counterintuitive for two reasons. First, until recently it was not possible to fabricate structural ceramic materials in thicknesses even as thick as 0.050 to 0.0100 inches matching the steel insets, let alone in the even thinner thicknesses required to bring internal stresses down to acceptable levels. Even today, only such companies as Kyocera, the largest supplier of ceramic materials in the world, and Norton Advanced Ceramics, the largest supplier of ceramic materials in the United States have proprietary technologies that allow them to produce structural ceramics in sections thin enough and having tolerances and surface finishes precise enough for use as wear plates according to our invention.

Furthermore, even had the ceramic materials been available in the desired thicknesses, it would have seemed absolutely counter-intuitive that wear plates formed from a material as brittle as glass in thicknesses of 0.005 to 0.0030 inches—0.005 inches being only slightly thicker than a page of this patent application—could survive the bending loads and other environmental conditions encountered by a wear plate under load in an axial piston device.

Yet another problem encountered in attempts to merely replace a steel insert loosely mounted on a supporting surface of a cam plate, as taught by Gostomski, with an insert of ceramic material arises due to the hard, wear resistant nature of the ceramic. Although it is said to be acceptable for the insert of Gostomski to rotate under load to some degree, with respect to the supporting surface, greater care must be taken to restrain a ceramic insert against rotation because, since the ceramic is so much thinner and more wear resistant than steel, such rotation could result in the ceramic insert cutting like a knife into the supporting steel structure to a point that the supporting structure becomes worn and severely damaged.

To preclude such wear and damage, therefore it would appear to be desirable to incorporate some means of retraining the ceramic insert from rotating with respect to the underlying support structure of the cam plate. Such restraint is also desirable in that it maximizes the effectiveness of the wear resistant surfaces by ensuring that all relative motion occurs between the piston slippers and the cam surface of the wear plate, rather than having some motion between the wear plate and the supporting surface whichdoes not normally need to be designed to resist wear.

Indeed some prior axial piston devices using a steel wear plate, similar to Gostomski, incorporate anti-rotation provisions such as locating pins, splines, or flats on the edges of the wear plate that interlock with compatible features in the cam plate support structure to prevent rotation of the wear plate with respect to the underlying cam plate support structure. Generally, however, these features cannot be used with ceramics for two reasons. First, features such as pins, flats, or spline teeth create concentrated point loads that, while they are acceptable for a ductile material such as steel, would tend to initiate fracture in brittle materials such as ceramic. Even if the ceramic material could withstand concentrated loads of the type imposed by the alignment pins used in prior steel wear plates having greater thickness, the extremely thin cross section of the ceramic inserts of our invention would physically not allow sufficient thickness for their use as antirotation devices in our invention. Second, the cost of fabricating ceramic wear plates having complex shapes such as spline teeth is prohibitively high.

Accordingly, it is an object of our invention to provide an improved axial-piston energy converting device offering enhanced performance and longer life which may be produced at low cost by providing a cam surface of a ceramic material having superior wear resistant capability. Other objects include providing:

a) a cam surface that may be readily retrofitted into existing axial piston devices; and b) a means for restraining a ceramic wear plate insert against rotation with respect to an underlying cam plate support structure.

SUMMARY

Our invention provides an axial-piston energy converting device meeting the objects stated above by utilizing a thin ceramic wear plate insert, having a typical thickness of only about 0.005 to 0.040 inches, as a cam surface secured by atmospheric pressure to an underlying support surface of a cam plate support structure.

Specifically, attachment of the wear plate to the cam plate is accomplished by polishing both a supporting surface of the cam plate, and a mating surface of the wear plate to a very smooth finish, and wiping a thin film of a fluid such as oil onto one of the polished surfaces prior to placing the wear plate onto the supporting surface. Because the surfaces are highly polished, together with the light film of oil, the resulting joint is essentially air tight. Atmospheric pressure acting on the cam surface of the wear plate serves to hold the wear plate tightly in place on the support surface in the same manner that a pair of Johansson blocks are held together if their highly polished surfaces are mated.

Our experience has been that where the mating surfaces of the wear plate and the underlying cam plate structure are polished to a finish of about one to ten micro inches (0.000001 to 0.000010 inches), wear plates thinner than 0.020 inches in thickness can be successfully utilized to provide enhanced performance and superior wear resistance in axial piston devices having steel supporting cam plate structures. The ability to successfully mount such thin ceramic inserts on the supporting surface allows the ceramic insert to deflect far enough under operating loads, without incurring unacceptably high internal loads, to stay in contact with and thus be fully supported by the underlying cam plate support structure, thereby solving the problem of cracking of the ceramic insert due to improper support encountered in prior attempts to utilize ceramic wear plate inserts of greater thickness or thin inserts mounted by methods other than those taught by our invention.

Our experience has further been that with the attachment methods described above, the wear plate will be restrained against virtually all rotation with respect to the cam plate support surface, thereby precluding wear of the underlying structure caused by undesirable rotation of the wear plate relative to the support structure.

Although the wear plate of our invention is preferably made of a ceramic material, the method of attaching the wear plate to an underlying support surface of a cam plate taught by our invention can also be used with significant advantage for attaching thin metallic wear plates to underlying support surfaces. With either ceramic or non-ceramic inserts, our invention is applicable to energy converting devices utilizing fixed or variable cam surfaces.

According to another aspect of our invention, a circular shaped wear plate insert having concentric inner and outer profiles is utilized to provide a wear resistant surface for piston slippers defining a generally elliptical orbital area of contact on the cam surface as the pistons rotate around an axis of rotation passing through the cam surface. The simple circular shapes of the wear plate profiles can be more readily formed in ceramic structures than more complex elliptical shapes, thus reducing both initial fabrication costs for the wear plate and refurbishment costs for the energy converting device when the wear plates are replaced.

The ability to use simple circular shaped ceramic wear plates provides superior wear resistance and repairability in comparison to previously used methods such as plating or flame spraying wear resistant coatings on cam plate surfaces at a cost which is comparable to or lower than the cost of applying such coatings.

Those skilled in the art will recognize that because our invention allows the use of very thin ceramic wear plate inserts, the thickness of the insert can be readily adjusted to provide acceptable internal stresses at a deflection matching that of the underlying cam plate support structure in an existing energy converting device designed for use with metallic wear plates. Our invention thus allows a thin ceramic wear plate offering improved wear resistance to be retrofitted into existing devices by essentially just replacing the steel insert previously used with a thinner ceramic insert mounted according to the teachings of our invention.

Other objects, advantages, and novel features of our invention will be readily apparent upon consideration of the following drawings and detailed description of the preferred embodiments.

DESCRIPTION OF THE INVENTION

Figure 1:
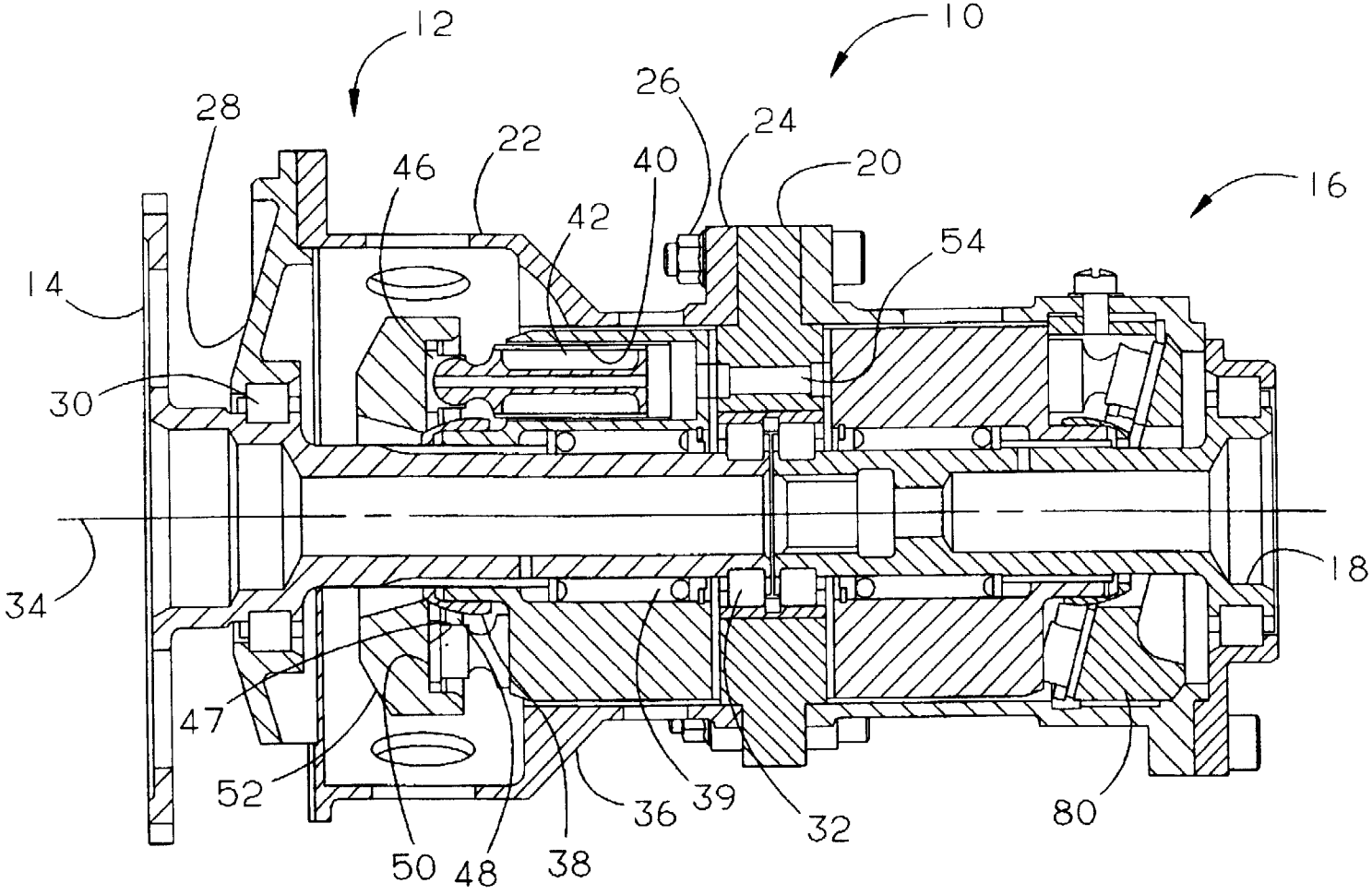
FIG. 1 is a cross sectional illustration of an axial-piston energy converting device according to our invention.

FIG. 1 illustrates an exemplary embodiment of our invention as applied to a typical energy converting device in the form of a hydraulic log 10 of the type used in constant speed drives for aircraft electric power systems. Similar energy converting devices are commonly also utilized as hydrostatic transmissions in the powertrains of farm machinery, or garden tractors to provide an infinitely variable ratio between the rotational speeds of an input shaft and an output shaft of the hydrostatic transmission.

As shown in FIG. 1, the hydraulic log 10 consists generally of a variable displacement axial piston pump 12 driven by input shaft 14, and a fixed displacement axial piston motor 16 that uses fluid provided by the pump 12 to drive an output shaft 18. Separating the pump and motor units 12, 16 is a port plate 19 having arc-shaped inlet and outlet ports (not shown) interconnecting the pump 12 with the motor 16. A charge pump (not shown) provides a supply of hydraulic fluid to the hydraulic circuit between the pump 12 and the motor 16 in a manner well known in the art.

The pump 12 includes a generally bell-shaped pump housing 22 having an open end 24 attached to the port plate 20 by fasteners 26, and a closed end 28 carrying a bearing 30 for supporting the left end (as illustrated in FIG. 1) of the input shaft 14. The right end of the input shaft 14 is supported in a bearing 32 mounted in the port plate 19, such that the input shaft 14 is rotatable about an axis of rotation 34.

A pump cylinder block 36, disposed about the shaft 14, slideably engages the left face of the port plate 20, and is connected through a spline joint 38 to the input shaft 14 to be driven thereby about the axis 34. Spring means 39 hold the pump cylinder block in sealing engagement with the left face of the port plate 20.

The pump cylinder block 36 includes several cylinders 40 oriented parallel to the rotational axis 34 of the input shaft 14, with each cylinder 40 housing a piston 42. The cylinders 40 are disposed in an annular array therein communicating with cylinder ports, as indicated at 54, to register with the arcuate ports (not shown) in the port plate 20. The left end of each piston 40 includes a swiveling piston slipper assembly 46 fabricated from a relatively soft material, such as bronze. Each slipper 46 includes a bearing surface 47 thereof plated with a material having high lubricity, such as silver, and configured to bear against a cam surface 50 of a cam plate in the form of a variable wobbler 52 (also sometimes known as a swash plate.) The slippers 46 are constrained by retainer means 48 in such a manner that the bearing surfaces 47 of the slippers are held in sliding contact with the cam surface 50 of the variable wobbler 52.

Figure 4:
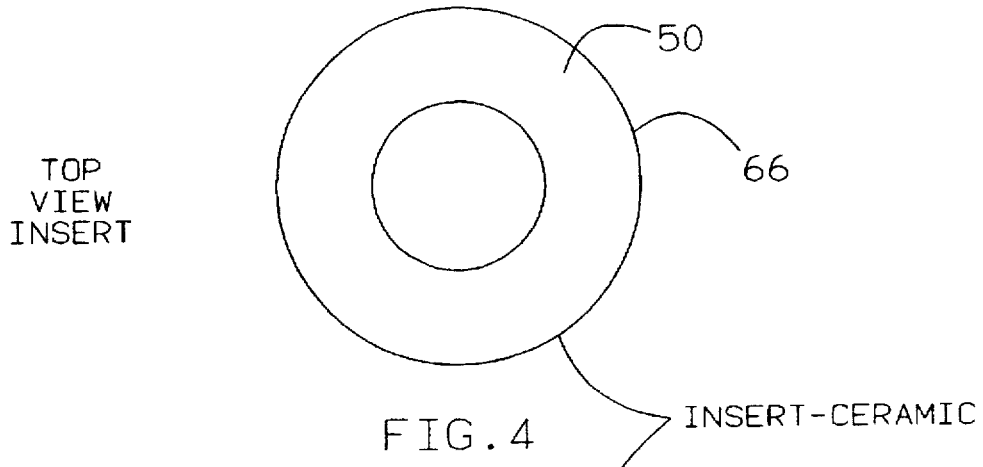
FIGS. 2–4 depict detailed features of a variable wobbler and ceramic insert from the axial-piston energy converting device of FIG. 1.
Figure 3:
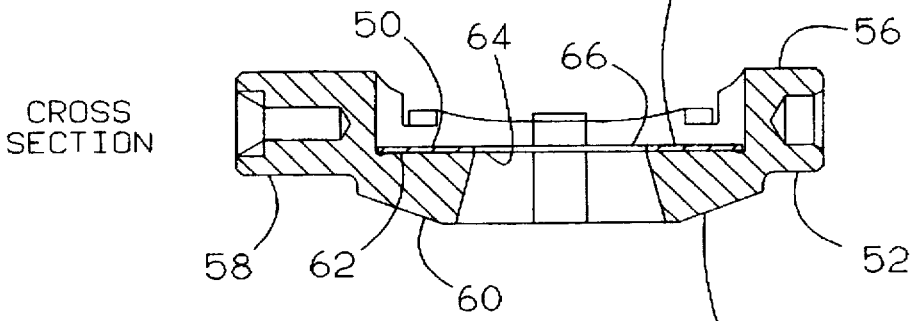
Figure 2:
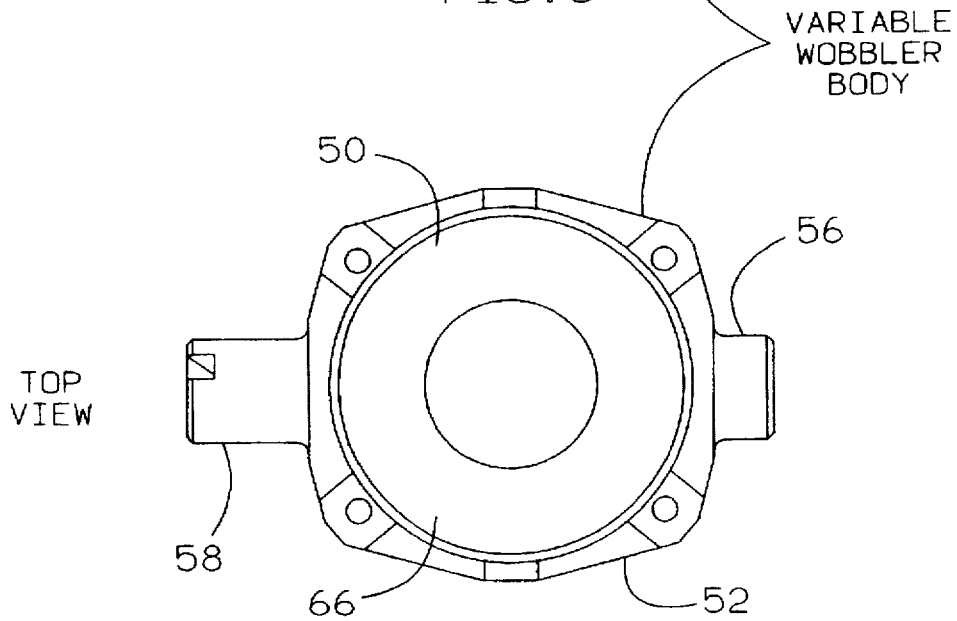

As shown in FIGS. 2 through 4, the variable wobbler 52 has a relatively complex configuration, and includes trunnion mounts 56,58 for mounting the wobbler 52 within the housing 22 in such a manner that the cam surface 50 can be selectively inclined with respect to the axis 34, in order to cause the pistons 44 to reciprocate in the cylinders 40 as the pump cylinder 40 is rotated about the axis 34 by the input shaft 14. The variable wobbler 52 includes an underlying support structure 60 having a relatively smooth and flat supporting surface 62 configured to mate with a faying surface 64 of a thin ceramic wear plate insert 66 having an opposite surface that provides the cam surface 50. When the wobbler 52 is installed in the assembled hydraulic log 10, the ceramic wear plate 66 is thus sandwiched between the support structure 62 of the wobbler 52 and the bearing surfaces 47 of the piston slippers 46.

In a preferred embodiment of the hydraulic log 10, the wobbler support structure 62 is fabricated from a steel having superior structural properties, such as the steel distributed under the trade name 300M, also known as AMS 6419. The ceramic insert 66 is preferably fabricated from a material having constituents from the group consisting of materials known as silicon nitride, and silicon carbide. The ceramic insert 66 is sufficiently thin to resiliently deform against the support surface 62 without incurring undue stress in the insert 66 when normal hydraulic pressure is present within the cylinders 40 of the pump 12. It is anticipated that generally insert 66 thicknesses in the range of 0.005" to 0.040" can be utilized, with thinner values in the range of 0.005" to 0.020" generally being preferred.

In a highly preferred embodiment of our invention, both the supporting surface 62 and the faying surface 64 are polished to a surface finish on the order of about one to ten micro-inches, and a thin coating of a fluid, such as oil or the same hydraulic fluid being used in the hydraulic log 10, is wiped onto either the faying or supporting surface 62,64 prior to installing the ceramic insert 66 onto the supporting surface 62. Our experience has shown that when the mating surfaces are polished to this degree, and the inserts 66 are installed over a thin film of fluid as described above, inserts 66 having thicknesses of 0.020" or less are held firmly in place on the supporting surface 62, and very minimal rotation of the insert 66 with respect to the support structure 60 occurs. We have also had good success with surface finishes as rough as about thirty-two micro-inches, but more rotation between the insert 66 and the supporting surface 62 must generally be accepted as surface roughness is increased.

The motor 16 is generally similar in construction to the pump 12 but it is of the fixed displacement type rather than the variable displacement type. As shown in FIGS. I and 5, the motor 16 includes a cam plate assembly in the form of fixed wobbler 80 that includes an underlying support structure 82 having a relatively smooth and flat supporting surface 84 configured to mate with a faying surface 86 of a thin ceramic wear plate insert 88 having an opposite surface that provides a cam surface 90. When the fixed wobbler 80 is installed in the assembled hydraulic log 10, the ceramic wear plate 90 is thus sandwiched between the support structure 82 of the wobbler 80 and bearing surfaces 92 of piston slippers 94 attached to motor pistons 96 that are constrained to slidingly engage the cam surface 90 of the ceramic insert 88 of the motor 16 in the same manner as previously described in relation to the pump 12.

In a preferred embodiment of the hydraulic log 10, the surface finishes, materials and method of mounting the insert 88 on the supporting surface 92 of the fixed wobbler 80 are the same as previously described with relation to corresponding features, parts, and methods of the pump 12.

Figures 5, 6:
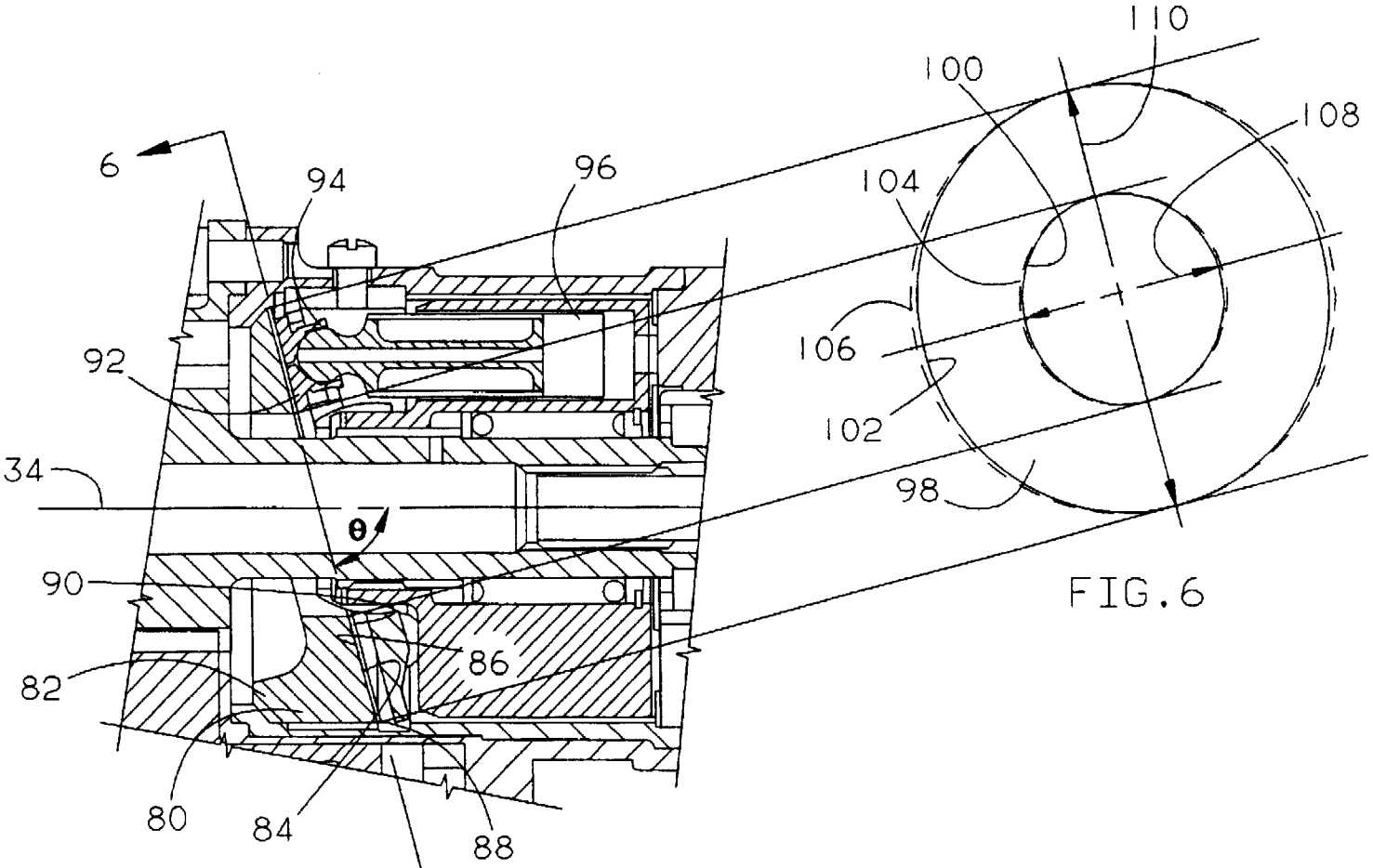
FIG. 5 is an enlarged cross sectional view of a fixed wobbler and ceramic insert from the axial-piston energy converting device of FIG. 1.
FIG. 6 is a view taken along line 6—6 in FIG. 5.

As shown in FIGS. 5 and 6, however, because the supporting and cam surfaces 84,90 of the fixed wobbler 80 are inclined at a fixed angle 6 with respect to the axis of rotation 34, the bearing surfaces 92 of the piston slippers 94 define a generally elliptical orbit 98 on the cam surface 90 of the insert 88, with the elliptical orbit 98 defining elliptically shaped radially inner 100 and radially outer 102 edges thereof. Machining the ceramic insert 88 to have an elliptical shape matching the elliptical orbit 98 swept by the piston slippers 94 would significantly increase the complexity and cost of the insert 88. In order to avoid incurring such additional complexity and cost, the ceramic insert 88 in a preferred embodiment of the hydraulic log is configured to be a simple circular washer having concentric inner and outer diameters 104, 106 respectively closely matched to a minor diameter 108 of the radially inner edge 100, and a major diameter 110 of the radially outer edge 102 of the elliptical orbit 98. With such an arrangement, the circular insert 88 completely encompasses the elliptical orbit 98 and provides a wear resistant surface upon which the bearing surfaces 92 of the piston slippers 94 can travel without over or under lapping the inner and outer diameters of the ceramic insert 88.

From the foregoing description, those having skill in the art will recognize that our invention provides an improved axial-piston energy converting device offering enhanced performance and longer life which may be produced at low cost by providing a cam surface of a ceramic material having superior wear resistant capability. It will also be recognized that our invention provides a cam surface that may be readily retrofitted into existing axial piston devices, and an improved means for mounting a ceramic wear plate on cam plate support surface in a manner that adequately restrains the ceramic wear plate insert against rotation with respect to an underlying cam plate support structure.

Those skilled in the art will further recognize that, although we have described our invention herein with respect to specific embodiments and applications thereof, many other embodiments and applications of our invention are possible within the scope of our invention as described in the appended claims. For example, our invention may be utilized in energy converting devices in which the cam plate rotates about an axis together with the cylinder and pistons, or in devices having a rotating cam plate and non-rotating cylinder and pistons. Furthermore, we wish to specifically point out that our invention is not limited to use with thin ceramic wear plates, but could also be used to provide improved mounting of inserts made from non-ceramic materials such as hardened steel.

It is understood, therefore, that the spirit and scope of the appended claims should not be limited to the specific embodiments described and depicted herein.

We claim:

1. An energy converting device comprising:

a) port plate means defining inlet and discharge ports;

b) a cylinder block rotatable relative to said port plate means about an axis passing through said port plate means;

c) said cylinder block having therein axially oriented cylinders serially communicable with the inlet and outlet ports in said port plate means;

d) pistons slidable in said cylinders and including bearing slippers pivotably mounted on the ends thereof; and e) cam plate means at one end of said cylinder block for reciprocating said pistons within said cylinders;

said cam plate means including:

a support structure that is deformable when normal hydraulic pressure is present within the cylinders of the device, said support structure also having a relatively smooth and flat supporting surface; and a thin insert of ceramic material mounted on said supporting surface between said support structure and said bearing slipper;

said ceramic insert being sufficiently thin to resiliently deform against said support surface without undue stress in the insert when normal hydraulic pressure is present within the cylinders of the device.

2. The energy converting device of claim 1 wherein said ceramic material is selected from the group consisting of silicon nitride, and silicon carbide.

3. The energy converting device of claim 1 wherein said insert has a thickness of about 0.005 to 0.020 inches.

4. The energy converting device of claim 1 wherein said supporting surface of said support structure and a faying surface of said insert bearing against said support structure both have surface finishes of about one micro-inch to thirty-two micro-inches.

5. The energy converting device of claim 4 further including anti-rotation means in the form of a thin coating of fluid disposed between said supporting and faying surfaces for restraining said insert from freely rotating with respect to said support structure about said axis.

6. The energy converting device of claim 5 wherein said supporting and faying surfaces both have surface finishes of about one micro-inch to ten micro-inches.

7. The energy converting device of claim 1 wherein said insert has a circular shaped, concentric inner and outer profiles respectively defining an inner and an outer diameter of said insert.

8. The energy converting device of claim 7 wherein:

said supporting surface is inclined with respect to said axis in such a manner that said slippers define a generally elliptical orbit on the surface of said insert about said axis, with said elliptical orbit defining radially inner and outer edges thereof;

said inner diameter of said insert is nominally less than or equal to a minor diameter of said inner edge of said elliptical orbit; and said outer diameter of said insert is greater than a major diameter of said outer edge of said elliptical orbit.

9. The energy converting device of claim 1 wherein said supporting surface is inclined at a fixed angle from said axis.

10. The energy converting device of claim 1 wherein said supporting surface is inclinable at varying angles from said axis, and said energy converting device further includes means for varying the angle of said support surface with respect to said axis.

11. An energy converting device comprising:

a) port plate means defining inlet and discharge ports;

b) a cylinder block rotatable relative to said port plate means about an axis passing through said port plate means;

c) said cylinder block having therein axially oriented cylinders serially communicable with the inlet and outlet ports in said port plate means;

d) pistons slidable in said cylinders and including bearing slippers pivotably mounted on the ends thereof; and e) cam plate means at one end of said cylinder block for reciprocating said pistons within said cylinders;

said cam plate means including:

a support structure that is deformable when normal hydraulic pressure is present within the cylinders of the device, said support structure also having a relatively smooth and flat supporting surface; and a thin insert mounted on said supporting surface between said support structure and said bearing slipper;

said insert being sufficiently thin to resiliently deform against said support surface without undue stress in the insert when normal hydraulic pressure is present within the cylinders of the device;

said supporting surface of said support structure and a faying surface of said insert bearing against said support structure both having surface finishes of about one micro-inch to thirty-two micro-inches; and having a thin coating of fluid disposed between said supporting and faying surfaces for restraining said insert from freely rotating with respect to said support structure about said axis.

12. In an energy converting device including:

a) port plate means defining inlet and discharge ports;

b) a cylinder block rotatable relative to said port plate means about an axis passing through said port plate means;

c) said cylinder block having therein axially oriented cylinders serially communicable with the inlet and outlet ports in said port plate means;

d) pistons slidable in said cylinders and including bearing slippers pivotably mounted on the ends thereof; and e) cam plate means at one end of said cylinder block for reciprocating said pistons within said cylinders;

said cam plate means including:

a support structure that is deformable when normal hydraulic pressure is present within the cylinders of the device, said support structure also having a relatively smooth and flat supporting surface; and a thin insert mounted on said supporting surface between said support structure and said bearing slipper;

said insert being sufficiently thin to resiliently deform against said support surface without undue stress in the insert when normal hydraulic pressure is present within the cylinders of the device;

a method for mounting said insert on said supporting surface comprising the steps of:

(1) polishing both said supporting surface of said support structure and a faying surface of said insert bearing against said support structure to surface finishes of about one micro-inch to thirty-two micro-inches; and (2) applying a thin coating of fluid to one of said supporting or faying surfaces prior to placing said surfaces in contact with one another.

* * * * *